United States Patent [19]

Gladrow et al.

[11] 4,200,520

[45] Apr. 29, 1980

[54] CATALYTIC CRACKING PROCESS

[75] Inventors: Elroy M. Gladrow; William E. Winter, both of Baton Rouge, La.

[73] Assignee: Exxon Research & Engineering Co., Florham Park, N.J.

[21] Appl. No.: 873,106

[22] Filed: Jan. 30, 1978

[51] Int. Cl.[2] ..... C10G 11/04; B01J 8/24

[52] U.S. Cl. ..... 208/120; 208/52 CT; 208/113; 208/251 R; 252/440; 252/455 Z

[58] Field of Search ..... 208/120, 111

[56] References Cited

U.S. PATENT DOCUMENTS

| | | | |
|---|---|---|---|
| 3,193,494 | 7/1965 | Sanford et al. | 208/120 |
| 3,711,422 | 1/1973 | Johnson et al. | 252/414 |
| 3,718,553 | 2/1973 | Stover | 208/120 |
| 3,788,977 | 1/1974 | Dolbear et al. | 208/120 |
| 3,944,482 | 3/1976 | Mitchell et al. | 208/120 |
| 3,977,963 | 8/1976 | Readal et al. | 208/120 |
| 4,013,546 | 3/1977 | Suggitt et al. | 252/415 |
| 4,064,038 | 12/1977 | Vermilion | 208/120 |

*Primary Examiner*—Delbert E. Gantz
*Assistant Examiner*—G. E. Schmitkons
*Attorney, Agent, or Firm*—Llewellyn A. Proctor

[57] ABSTRACT

The octane number of a cracked naphtha can be significantly improved in a catalytic cracking unit, without significant decrease in naphtha yield, by maintaining certain critical concentrations of metals on the catalyst, suitably by blending or adding a heavy metals-containing component to the gas oil feed. Suitably, in a catalytic cracking process unit wherein a gas oil feed is cracked in a cracking reactor (zone) at an elevated temperature in the presence of a cracking catalyst, the cracking catalyst is regenerated in a regenerator (regeneration zone) by burning coke off the catalyst, and catalyst is circulated between the reactor and regenerator, sufficient of a metals-containing heavy feedstock is admixed, intermittantly or continuously, with the gas oil feed to deposit metals on said catalyst and raise the metals-content of said catalyst to a level of from about 1500 to about 6000 parts per million, preferably from about 2500 to about 4000 parts per million expressed as equivalent nickel, based on the weight of the catalyst, and said metals level is maintained on the catalyst throughout the operation by withdrawing high metals-containing catalyst and adding low metals-containing catalyst to the regenerator.

9 Claims, No Drawings

CATALYTIC CRACKING PROCESS

Many refinery units provide stocks to form the gasoline blending pools which serve as a supply of motor gasoline. For example, stocks of natural or straight run gasoline are produced from virgin feeds by straight distillation. Alkylation units are employed to react low molecular weight olefins and paraffins to provide stocks within the gasoline boiling range. Cracking units are employed to reduce the molecular weight of feeds, and thereby provide stocks boiling in the gasoline range. Both virgin and cracked feeds in the gasoline boiling range, including naphthas, may be subjected to catalytic reforming, or hydroforming, to provide upgraded stocks, particularly stocks of increased octane. With the phaseout of lead anti-knock compounds it continues a formidable challenge for the refiner to maintain the gasoline pool at the octane levels demanded; and, the problem is aggravated by the depletion of conventional petroleum supplies which creates an increased need to process heavy feedstocks such as residua, unconventional heavy crudes and the like for conversion to gasoline.

Cracking processes, both thermal and catalytic, have constituted the heart of petroleum refining operations for several decades. The purpose of both types of process is the same, i.e., to break heavy molecular feed components into lower boiling, more valuable components. The thermal process, which has now been largely replaced by the more effective catalytic process, accomplishes this result by heat, whereas the catalytic process breaks the large molecules by contact between a heavy feed and an active catalyst at lower temperatures than used in thermal processes. The reactions which occur in the catalytic cracking operation are complex including, not only carbon-carbon bond scission but isomerization, alkylation, dehydrogenation, etc., and a carbonaceous material, or coke, is inevitably deposited on the catalyst. The catalyst, in such unit, is regenerated in a separate vessel, i.e., a regenerator, by burning off the coke to restore its activity. Commonly, the catalyst is continuously cycled between the reactor and regenerator as a moving bed without shutdown of either unit. Illustrative of commercial catalytic cracking processes are Airlift TCC as developed by Mobil Oil Corporation (Petroleum Refiner, Vol. 31, No. 8, August 1952, pp. 71–78); Fluid Catalytic Cracking as developed by Universal Oil Products Company (Petroleum Refiner, Vol. 30, No. 3, March 1951, pp. 130–136); Fluid Catalytic Cracking as developed by Esso Research and Engineering Company, Exxon Research and Engineering Company's predecessor (Petroleum Refiner, Vol. 35, No. 4, April 1956, pp. 201–205); Fluid Catalytic Cracking, Orthoflow, as developed by the M. W. Kellogg Company (Hydrocarbon Processing, Vol. 42, No. 5, May 1963, pp. 135–140); and Houdriflow Catalytic Cracking as developed by Houdry Process and Chemical Company, Division of Air Products and Chemicals, Inc.

The economics of the catalytic cracking unit in a refinery because of its high degree of flexibility, to a large extent, determines the product slate which will be produced by a refinery. Products from the catalytic cracking unit thus provide feed for other units, e.g., alkylation and polymerization units. Cat cycle stocks are used to make lubes, and gas is employed as fuel in the refinery.

Cat cracking feed stocks are provided by atmospheric and vacuum stills, phenol extraction plants and hydrotreaters. The usual feed to a commercial catalytic cracking unit is comprised of a gas oil boiling below about 1050° F. (1050° F.−), typically a virgin gas oil boiling between about 600° F. and 1050° F. In addition thermally cracked material is often used as a cat cracking feed. All of these feeds typically contain less than 1 ppm equivalent nickel (equivalent nickel is the total nickel (Ni) content plus 20 percent of the vanadium (V) content, i.e., Ni+V/5).

Feeds having an end boiling point above 1050° F. (1050° F.+) are not normally employed because such materials form heavy carbonaceous deposits, and contain metals which contaminate and poison the catalyst. These metals containing feeds include atmospheric distillation bottoms, vacuum distillation bottoms, and topped crudes. Atmospheric distillation bottoms or atmospheric residua contain both the 1050° F.+ and 600° to 1050° F. crude fractions while vacuum distillation bottoms, vacuum residua and the like, are comprised principally of 1050° F.+ material. Metals concentrations for the vacuum and atmospheric residua vary with crude type, but are substantially higher than 1 ppm as tabulated below:

| Crude | Ekofisk (North Sea) | Arabian Light | Arabian Light | Venezuela Heavy |
|---|---|---|---|---|
| Fraction | 650° F.+ | 650° F.+ | 1050° F.+ | 1050° F.+ |
| Metals Concentrations wppm | | | | |
| Ni | 4 | 7 | 21 | 111 |
| V | 2 | 23 | 70 | 806 |

In commercial catalytic cracking operations it is not always practical to completely eliminate metal-containing compounds from the feeds, particularly when there is an increasing demand being placed on the refiner to maintain, or increase the octane number of the gasoline pool. In typical operations, after months of operation using conventional low metals content heavy gas oil feeds the metal content of the catalyst circulated between the reactor and the regenerator of the catalytic cracking unit generally equilibrates at from about 200 to 1400 parts per million (ppm) metal content, based on the weight of the catalyst. Moreover, in the yet largely experimental, but now emerging "residcracking" operations where it is known to run 1050° F.+ endpoint hydrocarbon feed materials which contain nickel and vanadium in amounts of from about 2 to 100 ppm and higher over a catalyst in an effort to increase the available supply of gasoline for the pool, the metal content of the catalysts at normal or conventional replacement rates of about 0.14 lbs. of catalyst/Bbl of feed equilibrates at about 4700 to about 200,000 ppm, and at these levels the operation becomes uneconomical.

Gas oil feeds in admixture with other feed components are not commonly employed in catalytic cracking operations, but the use of such feeds in catalytic cracking processes is not unknown. Reference is thus made to U.S. Pat. No. 3,954,600 by Elroy M. Gladrow et al and the several other patents described therein at Column 1, lines 14–44. One of these patents, i.e., U.S. Pat. No. 2,464,810 discloses that heavy crude oils or tar can be catalytically cracked to produce a motor fuel by dissolving the heavy oil or tar in a naphtha solvent and subsequently subjecting the solution to a cracking reaction. Part of the naphtha fraction recovered from the catalytic cracking reaction product can be used as naphtha solvent for the heavy feed. Reference is also made to U.S. Pat. Nos. 3,781,197 and 3,785,959 by Millard C. Bryson et al. These patents disclose the cracking of a gas oil admixed with controlled amounts of residual oils, previously hydrodesulfurized or not hydrodesulfurized, over zeolite catalysts to improve octane values. Gasoline is improved, in accordance therewith, by upgrading the octane value of the mid-boiling range fraction of the gasoline, i.e., in the 125° to 300° F. range which includes the lowest octane fraction of the gasoline.

In the present state of the catalytic cracking art therefore, on the one hand, it is conventional practice to exclude the presence of heavy oil constituents e.g., residua, from catalytic cracking feedstocks to avoid metals contamination to the fullest extent possible. Where it is necessary to crack heavy residua, however, it is not feasible to exclude heavy metal substituents and, consequently, when such materials are used as feeds increased coke and hydrogen production results, and the activity and selectivity of the catalyst is adversely affected. Intensive efforts are underway to develop new generation catalysts which can operate for long periods without such adverse effects but metals contamination and poisoning remains a primary concern of refiners. On the other hand, where it is desired to crack a feed containing a heavy oil constituent the beneficial result achieved must be sufficiently great to economically off-set the result of catalyst contamination by the heavy metals present in the added heavy feed component. The inevitable effect of this phenomenon is that, in the overall operation of the process, the efficiency of the catalyst is impaired by metal contamination and poisoning.

It is, nonetheless, the primary object of this invention to provide an improved process which will at least in part overcome this disadvantage of present catalytic cracking processes, and in fact provide a new and novel catalytic cracking process for the cracking of gas oils.

A specific object is to provide a new and novel method for the operation of catalytic cracking units, notably one which will inprove the octane number of the cracked naphtha obtained from a gas oil with no significant adverse effect on liquid product yield.

These objects and others are achieved in accordance with the present invention which comprises maintaining a certain critical level of heavy metals on a cracking catalyst employed in a catalytic process unit, preferably by introducing, intermittantly or continuously, sufficient of a metals-containing heavy feedstock with said gas oil feed introduced into the cracking zone of the unit to deposit metals on said catalyst and raise the metals-content of said catalyst to a level ranging from about 1500 to about 6000 parts per million, preferably from 2500 to about 4000 parts per million parts by weight of the catalyst, expressed as equivalent nickel, and maintaining said metals level on the catalyst by withdrawing high metals-containing catalyst and adding low metals-containing catalyst to the cracking zone.

The typical catalytic cracking process unit is typically one wherein a gas oil feed is cracked in a cracking zone at an elevated temperature in the presence of a cracking catalyst, the cracking catalyst is regenerated in a regeneration zone by burning coke off the catalyst, and catalyst is circulated between the cracking zone and the regeneration zone. In accordance with the preferred embodiment of this invention, the metals-containing heavy feedstock is continuously added to said gas oil feed, or added to the reactor concurrently with said gas oil feed, in amounts ranging above 0 percent to about 25 percent, preferably from about 0.2 percent to about 10 percent, based on the volume of the gas oil, fresh catalyst is added to the regeneration zone at a rate of about 0.08 pounds to about 0.50 pounds, preferably from about 0.13 to about 0.30 pounds per barrel of gas oil feed processed, and catalyst is withdrawn at a rate sufficient to maintain the unit in balance.

The present invention is based on the discovery that there is a certain heavy metals level, somewhat higher than that normally attained in the production of cat cracked naphthas from gas oils, above which the selectivity of a catalyst can be improved, and octane increased; and another, a higher level, above which the operation becomes uneconomical because the excessive metals build-up on the catalyst adversely affects the selectivity, as well as the activity of the catalyst. In a preferred mode of operation the desired critical metals level is maintained throughout the catalytic cracking operation by introducing a 1050° F.+ material with the gas oil in the proportions stated, the 1050° F.+ material of which contains about 2 to about 1000 parts per million parts of equivalent nickel based on the weight of said material, to maintain the nickel (equivalent) content of the catalyst in the range of from about 1500 to about 6000 parts per million, preferably from about 2500 to about 4000 parts per million, based on the weight of the catalyst.

Suitable cracking catalysts include conventional silica-based materials which, preferably, contain bulk porous alumina dispersed therein. Illustrative of such catalyst are, e.g., amorphous silica-alumina; silica-magnesia; silica-zirconia; conventional clay cracking catalysts, etc. The amorphous gel silica-metal oxide cracking catalyst may further be composited with kaolin in amounts of about 10 to 40 wt. % (based on total weight of the composited catalyst) and up to 20 wt. % or more crystalline aluminosilicate zeolite, such as faujasite. These catalysts are well known and commercially available. Preferably, the catalyst utilized in the present invention is an amorphous silica-alumina catalyst containing from about 5 to 16 weight percent y-type faujasite, and, optionally 15 to 40 percent kaolin or preferably bulk porous alumina.

The runs are initiated by adjusting the feed and catalyst rates, and the temperature and pressure of the reactor to operating conditions. The run is continued at operating conditions by adjustment of the major process variables, within the ranges described below:

| Major Operating Variables | Typical Process Conditions | Preferred Process Conditions |
|---|---|---|
| Pressure, Psig | 0–50 | 5–20 |
| Reactor Temp., °F. | 800–1100 | 900–1030 |
| Space Velocity, W/W/Hr | 2–12 | 4–8 |
| Catalyst/Oil Ratio, (Instantaneous Vol. of Reactor Space) lbs./per lb. of oil | 4–50 | 6–16 |

The invention will be more fully understood by reference to the following nonlimiting demonstrations and examples which present comparative data which illustrate its more salient features. All parts are given in terms of weight except as otherwise specified.

EXAMPLE

A widely used commercial catalyst, believed to comprise about 15% rare earth form faujasite (Y-type), about 35% kaolin, and about 50% $SiO_2/Al_2O_3$ amorphous gel, was used in a continuous cracking operation feeding high metals content atmospheric residua to deposit (1) about 400 ppm, (2) about 3000 ppm, and (3) about 6000 ppm metals (as Ni equivalent) on portions of this catalyst. Each metals laden catalyst was evaluated for cracking performance in a continuous fluid bed cracking unit feeding a hydrotreated Heavy Arabian Atmospheric Residuum (20.7 Å PI gravity; 1.07 percent sulfur; 0.21 percent nitrogen; 7.5 percent Conradson carbon; 20.2 percent asphaltenes; and 72 ppm Ni+V), with the following results:

| Metals on Catalyst, ppm Eq. Ni. | 400 | 3000 | 6000 |
|---|---|---|---|
| Reactor Temperature, °F. | 950 | 950 | 979 |
| W/Hr/W | 9.2 | 11.1 | 8.4 |
| Conversion, Wt. % 430° F.- | 75.3 | 73.0 | 78.0 |
| $C_5$/430° F. Naphtha, Wt. % | 47.4 | 45.2 | 40.4 |
| RON (Clear), $C_5$/430° F. | 90.8 | 93.2 | 95.3 |
| Selectivity to $C_5$/430° F., % | 63 | 62 | 52 |

The catalyst with 3000 ppm metals is thus shown to give a much improved octane naphtha over the catalyst with only 400 ppm metals and at essentially no loss in naphtha selectivity. The test with the 6000 ppm metal catalyst was conducted at 979° F. which accounts in part for most of the indicated octane increase and in part for the loss in naphtha selectivity. For optimum octane improvement with no apparent loss in naphtha selectivity the metals content is kept in about the 1500–6000 ppm (Ni equivalent) range, preferably from about 2500–4000 ppm, based on catalyst weight. This is done expeditiously by controlling the metals content of the feed.

It is apparent that various modifications and changes can be made as in operating pressure, temperature, flow rates and the like without departing from the spirit and scope of the invention.

Having described the invention, what is claimed is:

1. In a catalytic cracking process unit wherein a gas oil feed is cracked in a cracking zone at an elevated temperature in the presence of a cracking catalyst, the cracking catalyst is regenerated in a regeneration zone by burning coke off the catalyst, and catalyst is circulated between the cracking zone and the regeneration zone, the improvement for obtaining a naphtha product of improved octane number comprising introducing sufficient of a nickel and vanadium metals-containing heavy feedstock with said gas oil feed introduced into the cracking zone to deposit nickel and vanadium metals on said catalyst and raise the nickel and vanadium metals-content of said catalyst to a level ranging from about 1500 to about 6000 parts per million of said metals expressed as equivalent nickel, based on the weight of the catalyst, and maintaining said nickel and vanadium metals level on the catalyst by withdrawing high nickel and vanadium metals-containing catalyst and adding low nickel and vanadium metals-containing catalyst to the regeneration zone.

2. The process of claim 1 wherein the metals-containing heavy feedstock added to said gas oil feed is one having a final boiling point above 1050° F.

3. The process of claim 1 wherein the metals-containing heavy feedstock is added to said gas oil feed prior to the introduction of the feed into the cracking zone.

4. The process of claim 1 wherein the metals-containing heavy feedstock added with said gas oil feed is one characterized as containing from about 2 to about 1000 ppm of equivalent nickel, based on the weight of said heavy feedstock.

5. The process of claim 1 wherein the metals-containing heavy feedstock is continuously added with said gas oil feed in amounts ranging above 0 percent to about 25 percent, based on the volume of the gas oil, fresh catalyst is added to the unit at a rate of about 0.08 pounds to about 0.50 pounds per hour per pound of gas oil feed processed, and catalyst withdrawn at a rate sufficient to maintain the unit in balance.

6. The process of claim 1 wherein the gas oil feed boils within a range of from about 600° F. to about 1050° F.

7. The process of claim 5 wherein the gas oil feed boils within a range of from about 600° F. to about 1050° F., and the metals containing heavy feedstock is added to said gas oil feed prior to the introduction of the feed into the cracking zone.

8. The process of claim 1 wherein the level of metals maintained on the catalyst ranges from about 2500 to about 4000 ppm expressed as equivalent nickel.

9. The process of claim 1 wherein the catalyst comprises a crystalline alumino-silicate zeolite.

* * * * *